US006760938B2

(12) United States Patent
Leng

(10) Patent No.: US 6,760,938 B2
(45) Date of Patent: Jul. 13, 2004

(54) BED BOARD

(76) Inventor: Luhao Leng, No. 139, Fanghu West Road Fanghu Industry District, Xiamen, Fujian Province (CN)

( * ) Notice: Subject to any disclaimer, the term of this patent is extended or adjusted under 35 U.S.C. 154(b) by 0 days.

(21) Appl. No.: 10/277,056

(22) Filed: Oct. 22, 2002

(65) Prior Publication Data

US 2003/0074737 A1 Apr. 24, 2003

(30) Foreign Application Priority Data

Oct. 24, 2001 (CN) ..... 1262336

(51) Int. Cl.[7] ..... A47C 31/00

(52) U.S. Cl. ..... 5/659; 5/658; 5/236.1
(58) Field of Search ..... 5/659, 658, 236.1, 5/226, 721

(56) References Cited

U.S. PATENT DOCUMENTS 2,616,100 A * 11/1952 Weiner ..... 5/236.1
2,699,558 A * 1/1955 Hapman ..... 5/659
2,728,089 A * 12/1955 Hynes ..... 5/659

* cited by examiner

*Primary Examiner*—Teri Pham Luu
*Assistant Examiner*—Fredrick Conley
(74) *Attorney, Agent, or Firm*—Greer, Burns & Crain, Ltd.

(57) ABSTRACT

A bed board includes a plurality of distance bars each having a "]" or generally "C"-shaped configuration with two ends, each end having a distance bar rabbet; a plurality of trips each having a "V" shape with an outer flank having a groove and an inner flank having a protrusion configured for engaging a corresponding one of the ends of the distance bars; and a plurality of side pillars each having a plurality of side pillar rabbets, each of the side pillar rabbets is configured for receiving a corresponding one of the plurality of trips and one of the ends of the distance bars.

1 Claim, 4 Drawing Sheets

BED BOARD

BACKGROUND OF THE INVENTION

1. Field of the Invention

The present invention is related to an improved bed board, featuring a construction which may be shipped in a reduced size format.

2. Background of Related Art

With the spread of globalization and integration of the global economy, manufacturing volume has increased, and at the same time the transportation fees are on the increase, sometimes, the transportation fees are equal to cost of the product. Therefore, an important issue for manufacturers is how to reduce storage and shipping volume products having relatively large volumes.

SUMMARY OF THE INVENTION

The main objective of the invention is to disassemble the bed board, forming the main bulk section of a bed, and to reduce the volume of the product in transport and storage. The present bed board includes distance bars, side pillars and trips. The distance bars are connected to the side pillars by the trips which are mounted on the side pillars. The side pillars each have rabbets into which the trips are inserted The trips have a "V" shape when viewed in section, the outer flank of the sections each have a groove and an inner flank of the sections have a protrusion. The distance bars have a "]" or generally "C"-shaped configuration, wherein two sides of the shape are inserted in the trips. The sides each have a rabbet associated with a corresponding protrusion.

A major drawback of the present bed boards is their side pillars being welded to distance bars, so the board occupies a large volume in storage and transport, and incurs increased transport fees. The distance bars and side pillars of the present utility bed board can be divided, and the present board is very convenient to assemble, the side pillars and distance bars occupy small bulk in packing transport, and more finished products can be stored in the space or package of an assembled board.

BRIEF DESCRIPTION OF THE DRAWINGS

FIGS. 3(*b, c*) are vertical and transect section cutaway illustration of the trips;

DETAILED DESCRIPTIONS OF THE PREFERRED EMBODIMENTS

Figure 1:
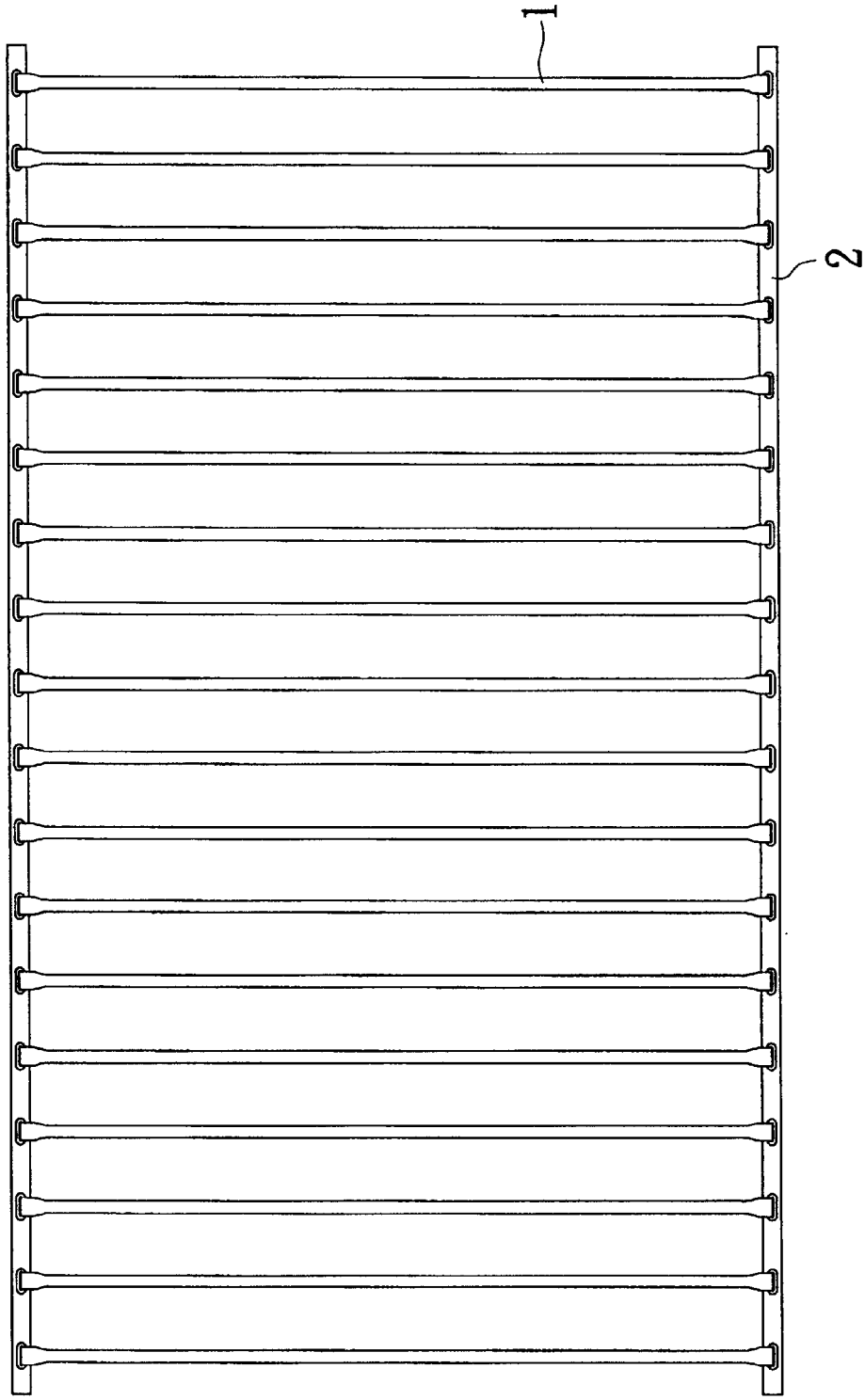
FIG. 1 is an abridged general view of the present utility bed board.
Figure 2B:
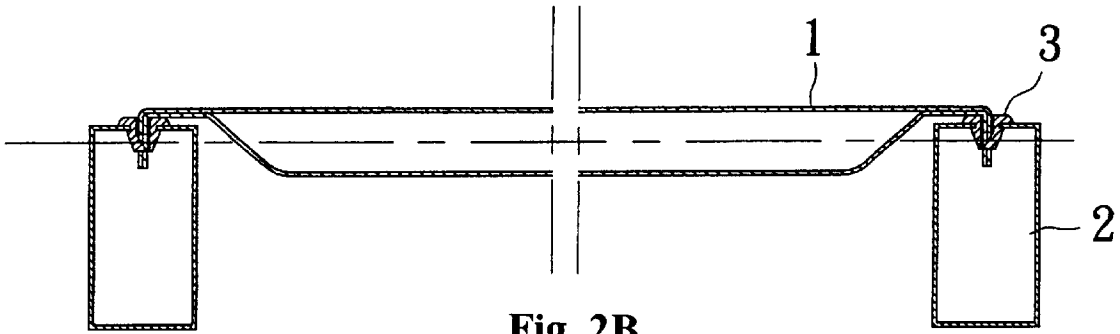
FIGS. 2(*a, b*) is a cutaway illustration and top view indicating the connection by side pillars and distance bars.
Figure 2A:
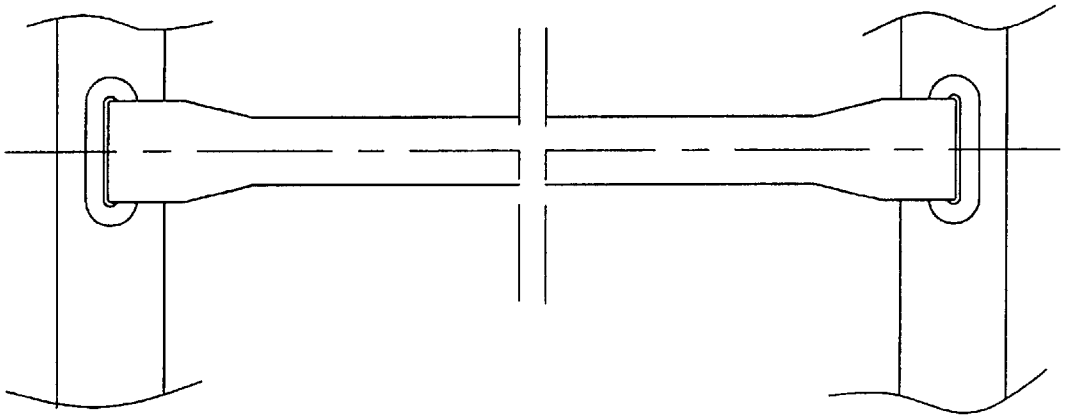
Figure 3A:
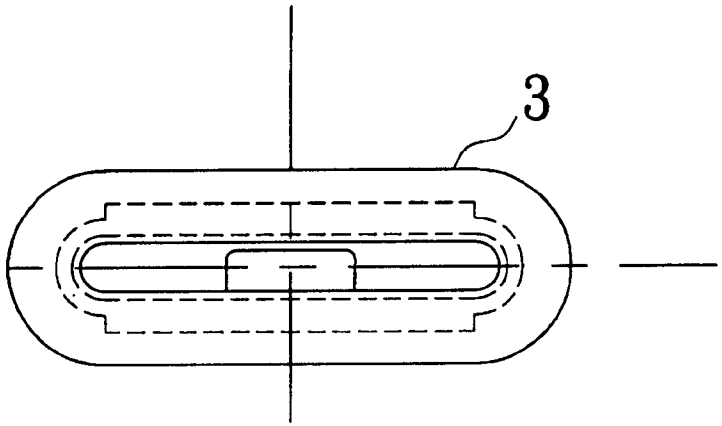
FIG. 3(*a*) is a front view of the present trips.
Figure 3B:
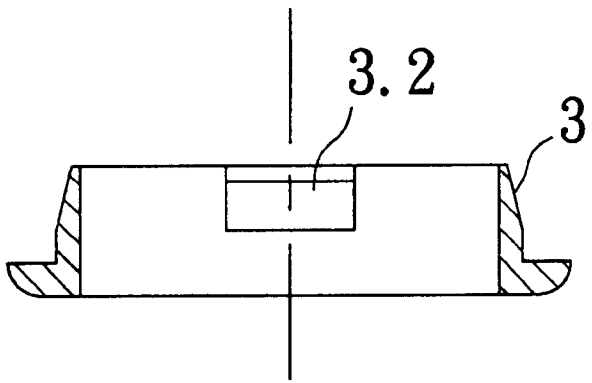
Figure 3C:
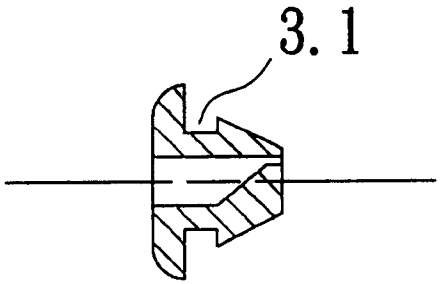
Figure 4C:
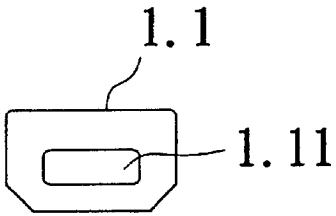
FIG. 4(*a*) is a front view of the distance bars, FIG. 4(*b*) is a top view of the present distance bars, and FIG. 4(*c*) is a side view of the present distance bars.
Figure 4A:
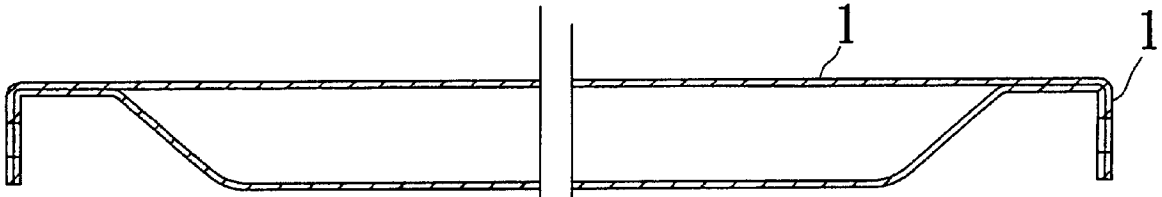
Figure 4B:
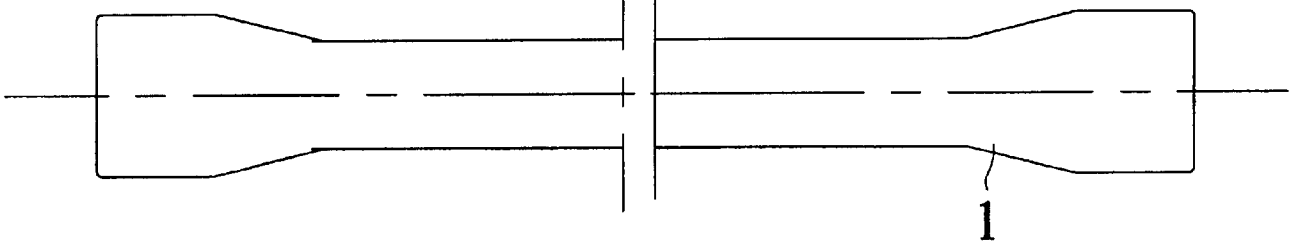

This production is as follows: a distance bar 1 and a side pillar 2 are metal pipes, and a pair of the side pillars each have a plurality of oval holes 2.1 on the side pillar 2, a trip 3 is inserted into each oval hole 2.1 and a groove 3.1 on two sides of the "V" shape of the trips being engaged in the oval hole. Both ends 1.1 of each said distance bar 1 are flattened, and include a long hole 1.11 on the flat shape 1.1. Also, the ends 1.1 generally form a 90° angle with a center portion of the distance bar 1. While assembling, one only need to insert the end 1.1 of said distance bar 1 into said plastic trip 3, a protrusion 3.2 in an oval hole of the trip 3 engages the long hole 1.1 on the end of said distance bar 1 automatically. Thereby, the distance bar 1 is fixed on the side pillars 2 and together, these components make up a bed board.

What is claimed:

1. A bed board comprising:

a plurality of distance bars each having a generally "C"-shaped configuration with two ends, each end having a distance bar rabbet;

a plurality of trips each having a "V" shape with an outer flank having a groove and an inner flank having a protrusion configured for engaging a corresponding one of said ends of said distance bars; and a plurality of side pillars each having a plurality of side pillar rabbets, each of said side pillar rabbets is configured for receiving a corresponding one of said plurality of trips and one of said ends of said distance bars.

* * * * *